United States Patent [19]

Monett

[11] 4,246,679

[45] Jan. 27, 1981

[54] RELEASABLE CLASP FOR A NECKLACE OR THE LIKE

[75] Inventor: Edward J. Monett, Westfield, N.J.

[73] Assignee: Roller Corporation of America, South Plainfield, N.J.

[21] Appl. No.: 953,479

[22] Filed: Oct. 23, 1978

Related U.S. Application Data

[63] Continuation-in-part of Ser. No. 864,468, Dec. 27, 1977, abandoned.

[51] Int. Cl.[3] ..... A44B 19/00

[52] U.S. Cl. ..... 24/230 R; 24/108; 24/221 R

[58] Field of Search ..... 24/221 R, 217, 230 R, 24/108

[56] References Cited

U.S. PATENT DOCUMENTS

| | | | |
|---|---|---|---|
| 2,612,139 | 9/1952 | Collins | 24/217 |
| 3,066,501 | 12/1962 | Charles | 24/217 |
| 3,286,316 | 11/1966 | Marosy | 24/221 R |
| 3,286,948 | 11/1966 | Franzen | 24/217 |
| 3,344,488 | 10/1967 | Texier | 24/221 R |
| 3,357,204 | 12/1967 | Davis | 24/217 |
| 3,689,962 | 9/1972 | Erickson | 24/108 |

*Primary Examiner*—Nile C. Byers, Jr.
*Attorney, Agent, or Firm*—Robert Scobey

[57] ABSTRACT

A releasable clasp for a necklace or the like wherein a rigid housing having an open end houses a tubular holder of flexible material with a transverse web having a hole therethrough adjacent the open housing end. Also included is a shaft of rigid material having an enlarged head at one end thereof which is sized so that the shaft head can pass through the hole in the web with the application of a predetermined joining force and can be withdrawn therefrom only upon application of a pre-established withdrawal force. The housing and holder together form a first clasp part, while the shaft constitutes a second clasp part. The shaft may be twisted to detent into a locking position.

14 Claims, 9 Drawing Figures

RELEASABLE CLASP FOR A NECKLACE OR THE LIKE

CROSS REFERENCE TO RELATED APPLICATION

This present application is a continuation-in-part of co-pending application Ser. No. 864,468 filed Dec. 27, 1977 for RELEASABLE CLASP FOR A NECKLACE OR THE LIKE (abandoned concurrently with the filing of the present continuation-in-part application).

BACKGROUND AND BRIEF DESCRIPTION OF THE INVENTION

This invention relates to releasable clasps, and more particularly to a clasp for a necklace or the like. An object of the invention is to provide a necklace clasp that is positive and at the same time easy to engage and disengage, i.e., a clasp that can be operated without fumbling and by feel alone. Many clasps presently in use are made of small parts hard to grasp and which require complicated manipulations to operate. The present invention involves a releasable clasp which overcomes the objections just noted.

Releasable holding devices have been utilized in the past. One patent disclosing such a device is Erickson U.S. Pat. No. 3,689,962 which issued Sept. 12, 1972, relating to a releasable button-like element in which a grooved shaft engages a flanged grommet. The grommet is otherwise unsupported, and does not provide a releasable holding device as in the present invention.

In the present invention, a releasable clasp specifically adapted for a necklace or other item of jewelry is provided, in which a holder comprising a web of flexible material is supported within a rigid housing. The web has a hole therethrough adjacent an open housing end, and the housing and holder together constitute a first clasp part. A shaft of rigid material having an enlarged head at one end thereof constitutes a second clasp part. The enlarged head is sized so that it can pass through by stretching the hole in the web with the application of a predetermined joining force and can be withdrawn therefrom only upon application of a pre-established withdrawal force, so as to releasably join together the two clasp parts. These first and second clasp parts may be made in decorative fashion, the holder of flexible material being supported within the rigid housing, completely out of sight. The two clasp parts can be easily joined together and removed. By the use of high strength silicone rubber, e.g., as the holder material, and by structuring the holder in the form of a generally tubular element which includes the web as a transverse part intermediate the ends thereof which engages the enlarged head of the shaft, the dimensions of the holder may be varied to vary the forces needed to join together and unjoin the two clasp parts. A locking pin may also be provided to lock the clasp parts together.

The invention will be more completely understood by reference to the following detailed description.

DETAILED DESCRIPTION

Figure 1:
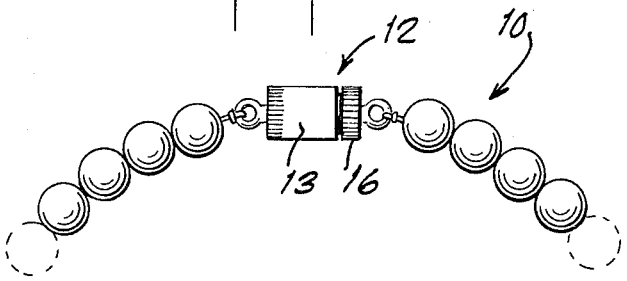
FIG. 1 is a view of a necklace including a releasable clasp embodying the invention as part thereof.
Figure 2:
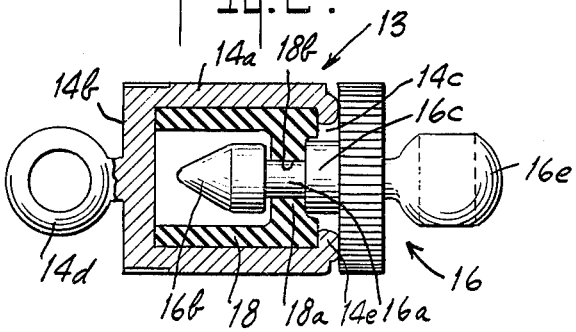
FIG. 2 is a sectional view, to an enlarged scale, of the clasp of FIG. 1.

Referring to FIG. 1, a necklace 10 is shown, the ends of which are joined together by a removable clasp 12. The clasp comprises a first clasp part 13 and a second clasp part 16 to which the ends of the necklace are attached. As shown in FIG. 2, the clasp part 13 is constituted of a rigid housing **14*a*, which advantageously may be of metal or other similar, suitable rigid material. The housing 14*a* is tubular, e.g., cylindrical in shape, and is closed at one end 14*b* and open at its opposite end, as at 14*c*. The end 14*b* of the housing may contain a ring 14*d* which is secured to the end wall of the housing by any convenient means, such as by welding, or integral forming therewith. The ring 14*d*** serves as an attachment to one of the ends of the strands of the necklace shown in FIG. 1.

Figure 4:
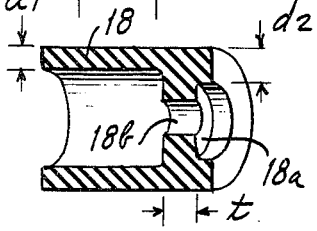
FIG. 4 is a sectional view of the flexible holder forming a part of the clasp of FIG. 2.

Positioned within the housing **14*a* and supported thereby is a holder 18 which is of flexible material. The holder 18 is also tubular and is positioned within and against the tubular housing wall 14*a*. The holder includes a transverse web 18*a* through which a hole 18*b* is formed. The holder 18 is shown in FIG. 4, and reference is made to that figure for a clear showing of the transverse web 18*a* and hole 18*b*. The transverse web 18*a* is positioned intermediate the ends of the holder 18, and in this case is positioned closer to that end of the holder that is adjacent to the open end 14*c* of the housing 14*a*. The open end of that housing may be swaged, as at 14*e* (see FIGS. 2 and 3) to retain the holder 18 within the housing 14*a*. The housing 14*a* and holder 18 together form first clasp part 13**.

The holder 18 is advantageously formed of high strength silicone rubber, with a Shore A durometer of from 50 to 75, e.g. What is desired is a highly flexible, high strength material which may flex many times with usage without wearing, tearing, or otherwise undergoing change upon repeated use.

Figure 3:
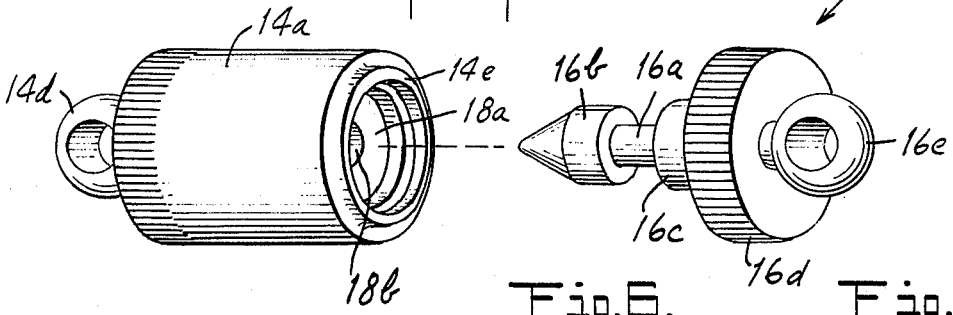
FIG. 3 is an exploded view of the parts of the clasp of FIG. 2.

The other clasp part 16 is shown in detail in FIGS. 2 and 3. That clasp part is made of rigid material, such as metal, and includes a shaft **16*a* which has an enlarged head 16*b* at one end thereof. The enlarged head 16*b* may be pointed at its forward end, as shown, to facilitate in passing through the hole 18*b* in the flexible web 18*a*. An enlarged part 16*c* is also included on the shaft 16*a*, spaced from the enlarged head 16*b* by a distance which is slightly greater than the thickness (t) of the web 18*a*. As shown in FIG. 2, the diameter of the enlarged part 16*c* is slightly less than the inside diameter of the holder 18 at the end thereof adjacent the open end 14*c* of the housing. This allows the enlarged part 16*c* to seat against the holder and essentially within that end of the holder. This second clasp part 16 is terminated by a terminal portion 16***d* adjacent to the enlarged part 16*c*. The terminal portion 16*d* is of a diameter or outside dimension about the same as that of the outside of the housing 14*a*, so that the two clasp parts 13 and 16 together present essentially a unitary structure in external appearance of uniform diameter or outside dimensions. A ring 16*e* is affixed to the terminal portion 16*d*, similar to the ring 14*d* attached to the housing 14*a*, and serving as an attachment to the other end of the necklace strand.

In use, the first and second clasp parts 13 and 16 are joined together by forceably pushing the enlarged head 16*b* through the hole 18*b*. The web 18*a* flexes sufficiently so that passage of the enlarged head through the hole can take place upon application of a predetermined joining force. The two clasp parts can be disengaged from each other upon application of a pre-established withdrawal force, again to force the enlarged head 16*b* through the hole 18*b*. As noted above, through the use of a suitable flexible material, such as high strength silicone rubber, the flexing action can take place many thousand times without destruction or wear. While utilizing a flexible holder tubular in shape, with an intermediate web, sufficient flexing of that web can take place to permit smooth passage of the enlarged head 16*b* through the hole 18*b*. The amount of force necessary to engage and disengage the two clasp parts is determined by the characteristics of the material forming the holder, such as durometer and modulus, and the dimensions, such as dimensions t, d1 and d2 in FIG. 4. Clasp joining and disengaging forces ranging anywhere from 2 grams to 5 pounds, for example, may be achieved depending upon material characteristics and dimensions. It is apparent from FIG. 4 that the wall thickness d2 is greater than d1. The thickness d1 generally determines the force necessary to join the two clasp parts 13 and 16 together; the thickness d2 generally determines the force necessary to disengage the clasp parts. The engaging force is thus made less than the disengaging force.

Figure 5:
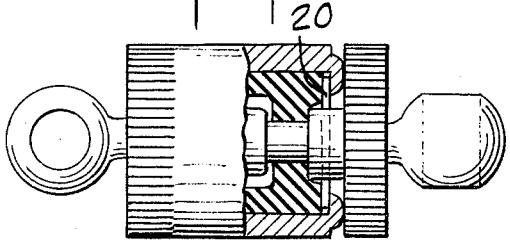
FIG. 5 is a partly sectional view of a clasp of the type shown in FIG. 2, modified to include a locking pin as a part thereof.
Figure 6:
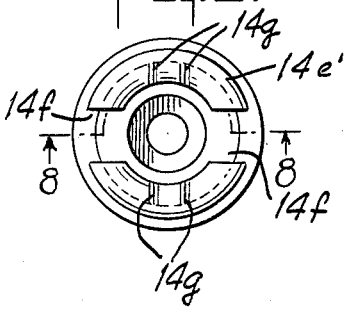
FIG. 6 is an end view of the clasp of FIG. 5, with the shaft part containing the locking pin removed.
Figure 7:
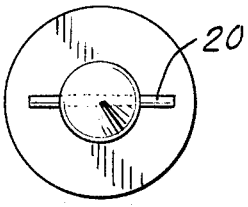
FIG. 7 is an end view of the shaft part that includes the locking pin.
Figure 8:
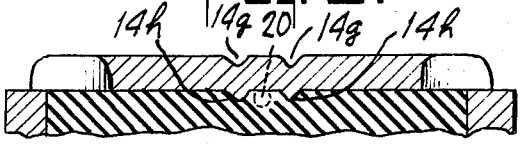
FIG. 8 is a sectional view, to an enlarged scale, of the clasp part shown in FIG. 6, taken along the section 8—8 in FIG. 6.

FIG. 5 shows a modified clasp with locking action. In this case, a pin 20 forms part of the shaft assembly. The swaged end 14*e'* of the housing may be grooved, as at 14*f*, to permit the pin 20 to pass through the flanged formed by the swaged end when the clasp parts are joined together. If the shaft member 16 is then twisted with respect to the housing 14*a*, the pin 20 is locked underneath the flange 14*e'*, thus preventing the two clasp parts from being withdrawn. Only if the shaft 16 is twisted further, re-aligning the pin 20 and flange grooves 14*f*, can the clasp parts be disengaged. If desired, the flange 14*e'* may be crimped, as at 14*g* (FIGS. 6 and 8), to provide ridges 14*h* (FIG. 8) which engage the locking pin 20 therebetween in the locked position of the clasp parts. It will be seen from FIGS. 5 and 8 that the end of the tubular holder 18 yieldably urges the locking pin 20 against the underside of the flange 14*e'*. Thus, when the clasp parts are twisted by roughly 90° after they are initially joined together, the locking pin 20 detents into locked position between the ridges 14*h*, providing a positive locking action.

Figure 9:
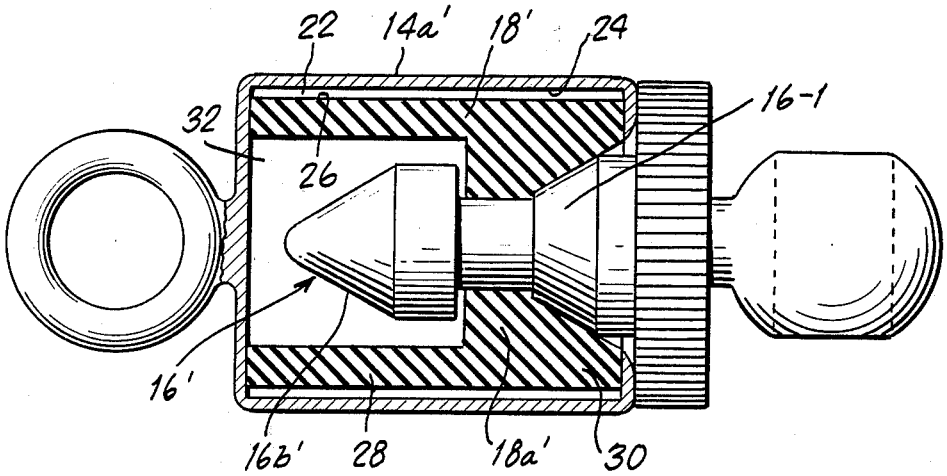
FIG. 9 is a view similar to FIG. 2 showing a presently preferred form of clasp embodying the invention.

Referring to FIG. 9, a modified form of clasp is shown, which is presently preferred. The clasp is similar to that shown in FIG. 2, and essentially only the holder 18' is changed (the shaft member 16' is slightly changed. In particular, holder 18' and housing 14*a'* are sized so that there is a slight air space 22 between inside wall portion 24 of the housing 14*a'* and the outside surface 26 of the holder 18'. The wall thickness of that holder is constant in the region 28 to the left of the web portion 18*a'* in FIG. 9 and is of increasing thickness in the region 30 thereof to the right of the web portion 18*a'*. The wall thickness increases proceeding from the end of the holder 18' that is closest to the web (the right-hand end of the holder) toward the web. The clasp part 16' is identical to the clasp part 16 in FIG. 2, except that the portion 16-1 is tapered so that the outside surface thereof fits against the adjacent surface of the holder 18' (in the region of the increasing wall thickness of that holder).

The construction in FIG. 9 permits the holder 18' to compress and to flex freely. Thus, as the clasp part 16' is inserted into the holder, the whole body of the holder compresses, and the web portion 18' stretches and flexes leftwardly to permit the enlarged head 16*b'* to enter the locking cavity portion 32 of the holder. Because the holder is not crimped to the metal retaining cup constituting the housing 14*a'*, and because of the air space 22, the entry of the enlarged head 16' into the locking cavity is achieved easily and with a force considerably less than the withdrawal force needed to remove the enlarged head from the locking cavity. The thickness of the web portion 18*a'* and the chamfered section 30 of increasing wall thickness determines the withdrawal force. Upon withdrawal of the enlarged head 16', the movement out of the locking cavity compresses the holder, increasing compressive forces in the rubber in the section 30. The flexing of the holder is much more restricted that it is when the enlarged head 16' is inserted into the locking cavity. In this fashion, the joining and withdrawal forces may be controlled independently of each other.

It should be noted that, in FIG. 9, the holder 18' is contacted by the housing 14*a'* only at its opposite ends. This feature, together with the space 22, permits the flexing action referred to above.

It will be appreciated that modifications of the presently preferred embodiments described above may be made. For example, while it is preferred to employ differing wall thicknesses of the holder 18 (18') on opposite sides of the intermediate web 18*a* (18*a'*), the thicknesses could be made equal. Also, the web 18*a* (18*a'*) could be a simple disc. Thus, the invention should be taken to be defined by the following claims.

I claim:

1. A releasable clasp for a necklace or the like comprising a rigid housing having an open end, a holder supported by said housing therewithin, said holder comprising a web of flexible material having a hole therethrough adjacent said open housing end, said web being transverse to and joined to a wall structure of flexible material, the wall thickness of said wall structure being greater on that side of said transverse web closer to said open housing end than on the other side of said web, said housing and holder constituting a first clasp part, and a shaft of rigid material having an enlarged head at one end thereof, said shaft constituting a second clasp part, said enlarged head being sized so that it stretches said hole and passes therethrough with the application of a predetermined joining force and is withdrawn therefrom only upon application of a preestablished withdrawal force, so as to releasably join together said two clasp parts.

2. A releasable clasp according to claim 1, in which said wall structure comprises a tubular member.

3. A releasable clasp according to claim 2, in which said web is intermediate the ends of said tubular member.

4. A releasable clasp according to claim 3, in which said second clasp part includes an enlargement thereon at a part of the shaft spaced from said enlarged head, said enlargement being seated against said web.

5. A releasable clasp according to claim 4, in which said enlargement has an outer surface that fits within and against the inner surface of said tubular member at the end thereof adjacent said open housing end.

6. A releasable clasp according to claim 5, in which said holder is of high tear strength and long flex life stretchable material.

7. A releasable clasp according to claim 1 in which said holder is supporeted within and by said rigid housing with a space between an inside wall portion of said housing and said wall structure of said holder.

8. A releasable clasp according to claim 7, in which said holder is contacted only at the ends of its wall structure by said rigid housing.

9. A releasable clasp for a necklace or the like comprising a rigid housing having an open end, a holder supported by said housing therewithin, said holder comprising a web of flexible material having a hole therethrough adjacent said open housing end, said housing and holder constituting a first clasp part, and a shaft of rigid material having an enlarged head at one end thereof, said shaft constituting a second clasp part, said enlarged head being sized so that it stretches said hole and passes therethrough with the application of a predetermined joining force and is withdrawn therefrom only upon application of a preestablished withdrawal force, so as to releasably join together said two clasp parts, in which said shaft includes a locking pin transverse thereto, and said rigid housing at said open end thereof includes a slotted flange through which said pin can pass, said flange retaining said locking pin thereunder when said shaft is twisted.

10. A releasable clasp according to claim 9, in which said locking pin is urged against the underside of said flange by the adjacent end of said tubular member.

11. A releasable clasp according to claim 10, in which said flange includes ridges on the underside thereof to retain said locking pin in shaft-locked position.

12. A releasable clasp for a necklace or the like comprising a rigid housing having an open end, a holder supported by said housing therewithin, said holder comprising a web of flexible material having a hole therethrough adjacent said open housing end, said housing and holder constituting a first clasp part, and a shaft of rigid material having an enlarged head at one end thereof, said shaft constituting a second clasp part, said enlarged head being sized so that it stretches said hole and passes therethrough with the application of a predetermined joining force and is withdrawn therefrom only upon application of a preestablished withdrawal force, so as to releasably join together said two clasp parts, in which said holder is of high tear strength and long flex life stretchable material, said web is transverse to and joined to a wall structure of a material the same as said web, said web is intermediate the ends of said wall structure, the wall thickness of said wall structure is greater on one side of said web than on the other side of said web, said web is positioned closer to that end of said wall structure of greater wall thickness than to the other end, and said holder is of increasing wall thickness proceeding from the end thereof closer to said web toward said web.

13. A releasable clasp according to claim 12, in which said rigid housing is tubular, and said tubular wall structure of said holder is supported within and by said rigid housing with a space between an inside wall portion of said tubular housing and said tubular wall structure of said holder.

14. A releasable clasp according to claim 13, in which said holder is contacted only at the ends of its tubular wall structure by said rigid housing.

* * * * *